US005712441A

United States Patent [19]

Grünewald

[11] Patent Number: 5,712,441

[45] Date of Patent: Jan. 27, 1998

[54] LAND-MINE SEARCH-AND-REMOVAL DEVICE MOUNTED ON A VEHICLE, ESPECIALLY A MILITARY TANK, AND METHOD OF LOCATING AND DESTROYING SUCH MINES WITH SUCH A DEVICE

[75] Inventor: Peter Grünewald, Fuldabrück, Germany

[73] Assignee: Firma Wegmann & Co., Kassel, Germany

[21] Appl. No.: 632,856

[22] Filed: Apr. 16, 1996

[30] Foreign Application Priority Data

Apr. 20, 1995 [DE] Germany ..... 195 14 569.0

[51] Int. Cl.[6] ..... F41H 11/16

[52] U.S. Cl. ..... 89/1.13; 86/50

[58] Field of Search ..... 89/1.13, 1.11, 89/50, 1.1; 102/401–403, 411; 86/50

[56] References Cited

U.S. PATENT DOCUMENTS

| | | | |
|---|---|---|---|
| H162 | 11/1986 | Sullivan, Jr. et al. | 102/403 |
| 3,716,005 | 2/1973 | Fennel | 89/1.1 |
| 4,021,725 | 5/1977 | Kirkland | 89/1.11 |
| 4,633,778 | 1/1987 | Joner et al. | 102/411 |
| 4,727,940 | 3/1988 | Bar-Nefy et al. | 171/84 |
| 4,773,298 | 9/1988 | Tischer et al. | 89/1.13 |
| 4,909,128 | 3/1990 | Grinwald | 89/1.13 |
| 4,932,831 | 6/1990 | White et al. | 414/732 |
| 5,263,396 | 11/1993 | Ladan et al. | 89/1.11 |
| 5,307,272 | 4/1994 | Butler et al. | 364/424.02 |
| 5,353,676 | 10/1994 | King et al. | 86/50 |
| 5,431,082 | 7/1995 | Zelverte et al. | 89/1.13 |
| 5,452,639 | 9/1995 | Aulenbacher et al. | 89/1.13 |
| 5,458,063 | 10/1995 | Laine et al. | 102/402 |
| 5,598,152 | 1/1997 | Scarzello et al. | 340/850 |

FOREIGN PATENT DOCUMENTS

| | | | |
|---|---|---|---|
| 909874 | 5/1946 | France | 89/1.13 |
| 3526492 | 1/1987 | Germany | 89/1.13 |

OTHER PUBLICATIONS

*Popular Mechanics* article, "Army's 'Mine Scenting' Jeep Locates Buried Explosives", p. 16, Jan. 1946.

*Primary Examiner*—Michael J. Carone
*Assistant Examiner*—Christopher K. Montgomery
*Attorney, Agent, or Firm*—Sprung Kramer Schaefer & Briscoe

[57] ABSTRACT

A land-mine search-and-removal device mounted on a vehicle, especially a military tank. A framework (1) can be attached to the front of the vehicle (KP) by a coupling (2 & 2.1). Several sensors (3.1, 3.2, 3.3, & 3.4) designed to detect electrically conductive objects (M) are distributed along the front, in the direction (F) of travel, of the frame to a prescribed extent at least the width of the vehicle. A carriage (5) is driven back and forth and stopped at any point along rails (4) extending athwart the vehicle and behind the sensors. A hunting detector (6) is mounted on the carriage and precisely detects the type and position of any object sensed by the sensors. A moving pickup (8) is mounted on the carriage, picking up explosive or hollow charges (13 & 14), and depositing them in a precise position on the ground. A magazine (9) is mounted on the carriage or framework and accommodates the explosive or hollow charges equipped with detonators. An electrical operating and processing system is provided for the sensors, the carriage-driving mechanism, the detector, the pickup, and the detonators.

14 Claims, 2 Drawing Sheets

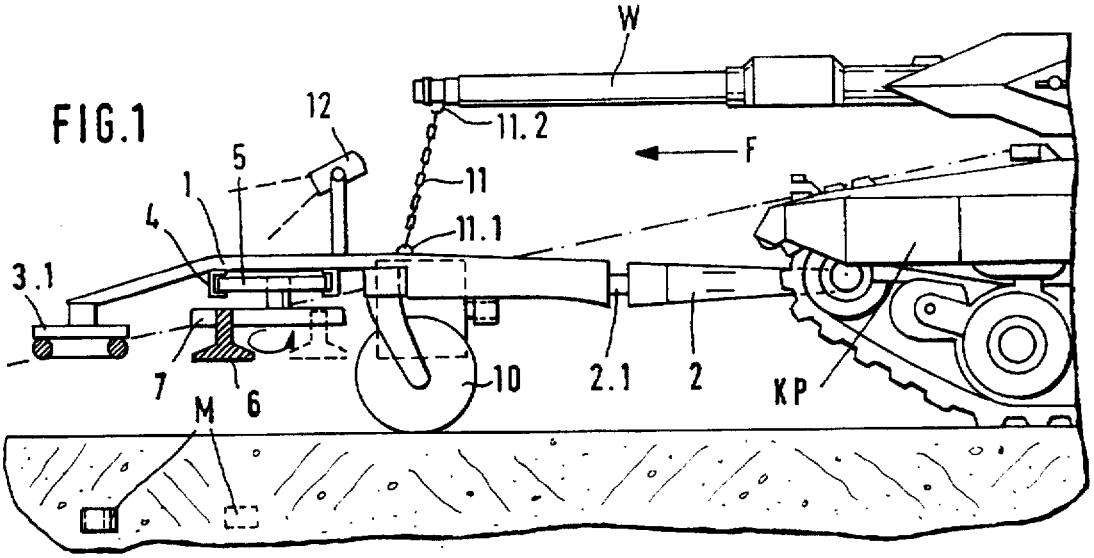
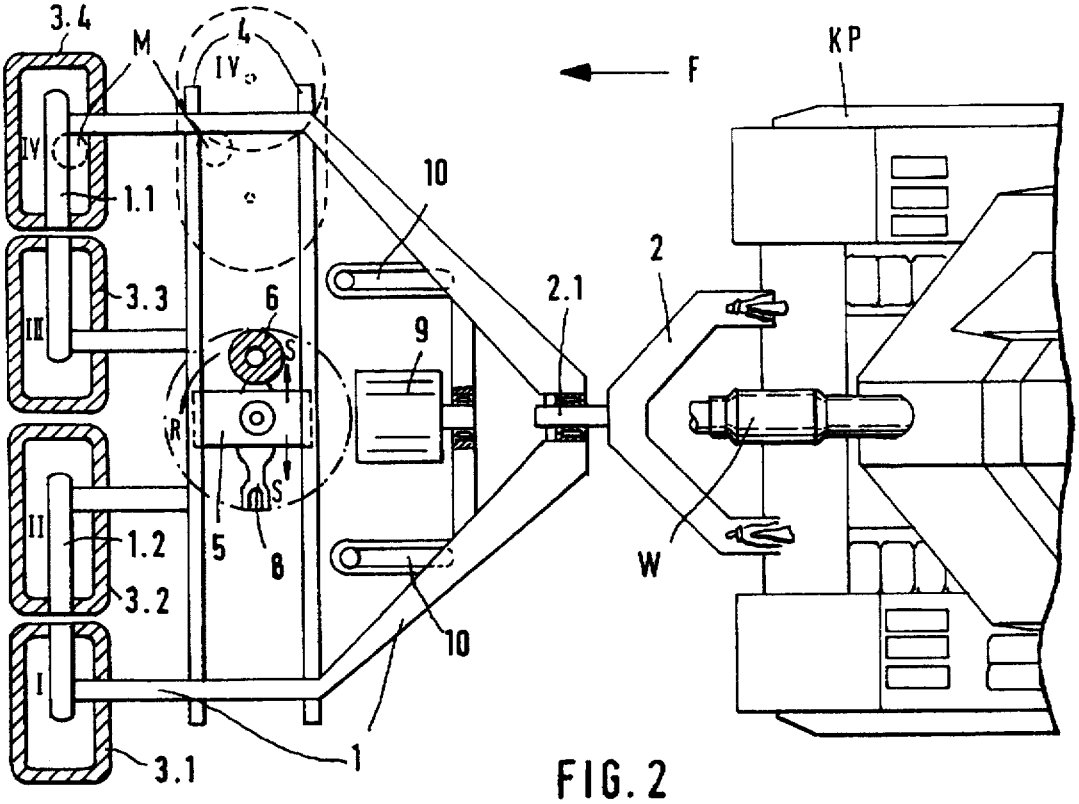
FIG. 2

LAND-MINE SEARCH-AND-REMOVAL DEVICE MOUNTED ON A VEHICLE, ESPECIALLY A MILITARY TANK, AND METHOD OF LOCATING AND DESTROYING SUCH MINES WITH SUCH A DEVICE

BACKGROUND OF THE INVENTION

The present invention concerns a land-mine search-and-removal device mounted on a vehicle, especially a military tank. The invention also concerns a method of locating and destroying such mines with such a device.

Searching for and removing mines with devices mounted on vehicles, especially tanks, is known. The known devices can be plows, rollers, or flails. They entail certain drawbacks. First, they must be massive enough to directly sustain the detonation of the mines. Second, they can entail considerable damage to the environment being worked.

SUMMARY OF THE INVENTION

One object of the present invention is accordingly a search-and-removal device mounted on a vehicle, especially a military tank, that can with high probability detect antitank mines and optionally antipersonnel mines within a prescribed strip of ground along the direction of travel, locate them precisely, and remove them individually. A lane will accordingly be opened between the mines. The device will be able to detect both hidden and exposed mines.

This object will be attained in accordance with the present invention in a land-mine search-and-removal device of the aforesaid genus with a) a framework that can be attached to the front of the vehicle by a coupling, b) several sensors designed to detect electrically conductive objects and distributed along the front, in the direction of travel, of the frame to a prescribed extent at least the width of the vehicle, c) a carriage driven back and forth and stopped at any point along rails extending athwart the vehicle and behind the sensors, d) a hunting detector mounted on the carriage and precisely detecting the type and position of any object sensed by the sensors, e) a moving pickup mounted on the carriage, picking up explosive or hollow charges, and depositing them in a precise position on the ground, f) a magazine mounted on the carriage or framework and accommodating explosive or hollow charges equipped with detonators, and g) an electrical operating and processing system for the sensors, the carriage-driving mechanism, the detectors, the pickup, and the detonators.

The search-and-removal device in accordance with the present invention makes it possible to carry out a method of mine location and destruction comprising the steps A) moving the vehicle forward at a prescribed speed with the sensors activated, B) stopping the vehicle with a prescribed braked residual advance when one of the sensors signals that something has been sensed, C) determining what sensor has emitted the signal, displacing the carriage into the vicinity of that sensor, and activating the hunting detector, D) probing a prescribed area of the ground with the detector while correspondingly displacing the carriage and pivoting the arm, E) processing the signals emitted by the detector in order to determine the precise nature and position of the detected object, F) actuating the pickup to pick up an explosive or hollow charge stowed in the magazine and positioning it at the point on the ground determined by the processing, G) backing the vehicle up a prescribed distance, H) exploding the explosive or hollow charge from the vehicle, and I) driving the vehicle forward at a prescribed speed with the sensors activated.

The point of departure for the present invention is to mount assemblies on a framework that can be coupled to the front of a vehicle, suspended from the vehicle, and supported on wheels in such a way that the presence of electrically conductive objects can initially be roughly sensed by appropriate sensors, that the nature and position of an object sensed by the sensors can then be precisely detected by a moving hunting detector, and finally that an explosive or hollow charge can be positioned over the mine and exploded. Since the vehicle stops as soon as a sensor responds, and retreats to a safe distance once the charge has been positioned over the point precisely established by the detector, damage to the search-and-removal device or to the vehicle is very unlikely, and the overall device can accordingly be lighter in weight. Furthermore, the purposeful and measured employment of explosive or hollow charges to destroy the mines prevents undue damage to the environment. Since hollow charges can be aimed, they are particularly appropriate for destroying buried mines.

When a tank is employed as a vehicle, the crew can carry out their duties fully protected from missiles and from ABC weapons. The combat readiness of the tank will be extensively maintained while the mines are being eliminated. The driver's field of vision will be only minimally restricted even when the search-and-removal device is raised.

Search and removal are controlled and monitored by an electrical operating and processing system inside the vehicle that can include a monitor, controls, a computer, and adaptors. The overall search-and-removal control and operation can be extensively automated and computerized.

One embodiment, of the search-and-removal device in accordance with the present invention and of the method of locating and destroying land mines therewith will now be specified with reference to the accompanying drawing, wherein

BRIEF DESCRIPTION OF THE DRAWINGS

FIG. 1 is a highly schematic side view of part of a military tank with a land-mine search-and-removal device mounted on the front, FIG. 2 is a top view of the tank with the device illustrated in FIG. 1.

DETAILED DESCRIPTION OF THE INVENTION

Figure 3:
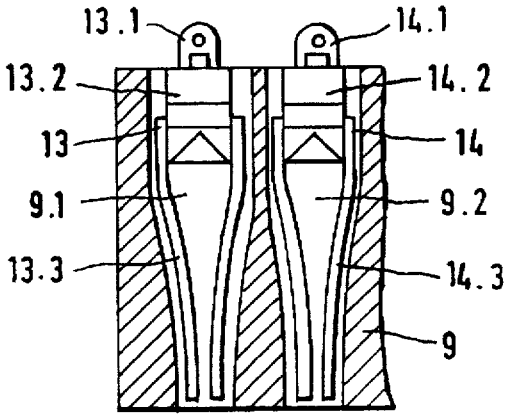
FIG. 3 is a larger-scale section through the magazine for explosive and hollow charges in the device illustrated in FIG. 2, and FIGS. 4 and 5 are side views of a stand erected on the ground with hollow charges for destroying mines positioned on or beneath the ground.

A framework 1 is coupled by a coupling 2 to the front of the military tank KP illustrated in FIGS. 1 and 2. Four sensors 3.1, 3.2, 3.3, and 3.4 in the form of rectangular electromagnetic coils are mounted on each of two transverse sensor-supporting beams 1.1 and 1.2 extending athwart and along the front, in terms of the direction F of travel, of framework 1. Sensors 3.1, 3.2, 3.3, and 3.4 are distributed to an extent that is greater by a prescribed amount than the width of tank KP. The sensors sense the presence of an electrically conductive object and are connected in an unillustrated way to an operating and processing system inside the tank.

Transverse rails 4 are mounted along framework 1 behind the sensors. A carriage 5 rides back and forth in the direction indicated by arrows S, at a right angle to direction F of travel. The unillustrated mechanism that drives carriage 5 can also be controlled by the operating and processing system in tank KP.

An arm 7 pivots horizontally on the bottom of carriage 5 in the direction indicated by arrow R subject to an also unillustrated mechanism. Mounted on arm 7 is a hunting detector 6 that precisely detects the type and position of any object sensed by sensors 3.1, 3.2, 3.3, and 3.4 as will be specified hereinafter. Also mounted on 5 as will be evident only from FIG. 2 is a pickup 8 for picking explosive and hollow charges up and precisely depositing them on the ground along with detonators. The charges are stowed in a magazine 9 mounted on the framework.

Behind rails 4 and carriage 5, framework 1 rests on the ground on two wheels 10. Framework 1 is also suspended from tank KP by way of a suspension 11 that engages an attachment 11.1 on framework 1 and another attachment 11.2 on weapon W. Suspension 11 can, although not so represented, be a mechanism controlled from inside the tank that raises framework 1 and the assemblies attached thereto for transportation.

Also mounted on framework 1 is a video camera 12 that is connected in an unillustrated way to the electrical operating and processing system inside tank KP. To decrease the overall width of the search-and-removal device, especially when it is in the transport position, the two outermost sensors 3.1 and 3.4 can fold up and in in an unillustrated way around horizontal axes the parallel direction F of travel. Special lighting systems can be mounted on framework 1 or on tank KP in an unillustrated way to illuminate the area being worked on by sensors 3.1, 3.2, 3.3, and 3.4 or detector 6.

FIG. 3 is a detail of the magazine the explosive and hollow charges are stowed in.

Figure 4:
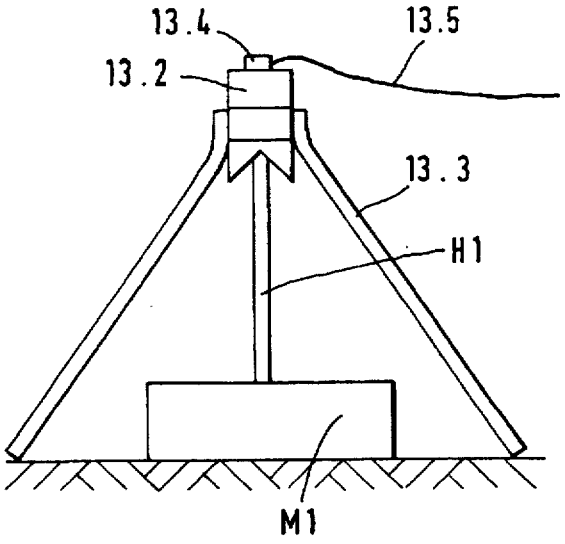
Figure 5:
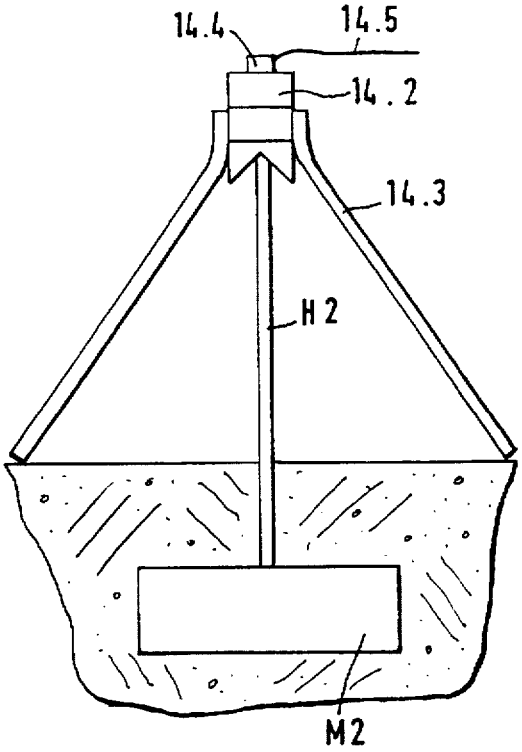

The charges are accommodated in the top 13.2 of a stand 13 and in the top 14.2 of a stand 14. Each stand 13 and 14 has between three and five resilient-steel legs 13.3 and 14.3. The legs fold together once the stands have been inserted into chambers 9.1 and 9.2 in magazine 9 as illustrated in FIG. 3. On top of each stand 13 and 14 is a holder 13.1 and 14.1 that can be engaged by pickup 8, which is mounted on a robot arm. When pickup 8 extracts the charges from magazine 9, legs 13.3 and 14.3 unfold automatically, allowing pickup 8 to position stands 13 and 14 at any prescribed point on the ground as illustrated in FIGS. 4 and 5.

The top 13.2 of stand 13 is provided with a reel 13.4 of cable 13.5 and the top 14.2 of stand 14 with a reel 14.4 of cable 14.5. The cables connect a primer in each charge to the electrical operating and processing system in tank KP.

The method of locating and destroying a mine with the aforesaid search-and-removal device will now be specified.

The search-and-removal device is mounted as aforesaid on the front of tank KP with framework 1 lowered enough for wheels 10 to rest on the ground. Sensors 3.1, 3.2, 3.3, and 3.4 and detector 6 can be approximately 500 mm off the ground. The operating and processing system in tank KP can be accessible from the loader's side and is connected to the search-and-removal device by cable through a periscope adaptor. The sensors are activated and the video-monitoring system is on. All apertures are closed.

The tank advances over the terrain at a constant speed of approximately 5 km and hour. A signal is immediately emitted as soon as one of the sensors, sensor 3.4 in FIGS. 1 and 2 in the present case, senses the presence of and electrically conductive object M. The tank is stopped immediately, optionally automatically. The braked residual forward motion can be between 1 and 1.5 m.

The electrical operating and processing reveals which sensor 3.1, 3.2, 3.3, and 3.4 has responded. Carriage 5 shifts detector 6 into the associated area and activates it. The area, 1 $m^2$ for example, wherein the mine is suspected of being is now scanned by detector 6. This is done simply by rotating arm 7 while carriage 5 moves athwart. The result of this procedure is the determination and registration of the precise position and optionally of the nature of the detected object. Camera 12 can be employed to supplement the identification and to locate exposed objects.

If the probability is high that the object is a mine, its destruction is initiated. A decision is made as to whether to use an explosive charge (for an exposed mines) or a hollow charge (for a buried mine). With the tank still stationary, pickup 8 removes a charge 13 or 14 from magazine 9 and deposits it directly over the mine as illustrated in FIGS. 4 and 5. The procedure can be monitored through camera 12.

Framework 1 is now lifted and tank KP backed up to a safe distance of approximately 20 to 30 m. The charge is detonated from tank KP through the aforesaid cable. Detonation and destruction can be observed through the vehicle's optical system. FIG. 4 represents a situation wherein a mine M1 resting on the ground is impacted and destroyed by a beam H1 of energy from a hollow charge. The underground mine M2 in FIG. 5 on the other hand is destroyed by a hollow-charge beam H2.

Once the mine has been destroyed, the hunt can be continued from the same point. The cleared lanes can be automatically marked.

What is claimed is:

1. A land-mine search-and-removal device mountable on a vehicle, comprising:

a) a framework attachable to a front of the vehicle by a coupling, b) several sensors designed to detect electrically conductive objects and distributed along the front, in the direction of travel of the framework to a prescribed extent at least the width of the vehicle, c) a carriage driven back and forth and stopped at any point along rails extending athwart the vehicle and behind the sensors, d) a hunting detector mounted on the carriage and precisely detecting the type and position of any object sensed by the sensors, e) a moving pickup mounted on the carriage, picking up explosive or hollow charges, and depositing them in a precise position on the ground, f) a magazine mounted on the carriage or framework and accommodating the explosive or hollow charges equipped with detonators, and g) an electrical operating and processing system for the sensors, the carriage-driving mechanism, the detector, the pickup, and the detonators.

2. The search-and-removal device as in claim 1, further comprising supporting wheels on a bottom of the frame and behind, in the direction of travel, the carriage.

3. The search-and-removal device as in claim 2, wherein the coupling includes a pivoting articulation to compensate for irregularities in the terrain.

4. The search-and-removal device as in claim 1, wherein the framework is suspended by a suspension at the top from a component that projects out of the vehicle.

5. The search-and-removal device as in claim 4, wherein the vehicle is a tank and the projecting component is a weapon barrel.

6. The search-and-removal device as in claim 1, wherein the sensors that sense the presence of electrically conductive objects are electromagnetic coils with essentially vertical axes.

7. The search-and-removal device as in claim 6, wherein the coils are rectangular and their longer sides extend across the direction of travel.

8. The search-and-removal device as in claim 1, wherein the detector is suspended at a prescribed distance from a pivot from an arm that pivots in a horizontal plane below and is attached to the framework.

9. The search-and-removal device as in claim 1, further comprising a video camera mounted on the top of the framework and connected to the electrical operating and processing assembly.

10. The search-and-removal device as in claim 1, wherein each explosive and hollow charge stowed in the magazine is accommodated in a stand that can be grasped at the top by the pickup and rests with its base against the ground.

11. The search-and-removal device as in claim 10, wherein a base of each stand accommodates several automatically expanding legs and wherein the magazine is designed to accommodate each stand vertically with its legs folded in within a compartment such that the legs expand when the stand is extracted.

12. The search-and-removal device as in claim 10, further comprising a detonating cable wrapped around a reel at the top of each stand and connected to the electrical operating and processing assembly.

13. A method of locating and destroying a land mine with the search-and-removal device recited in claim 1, wherein at least to some extent automatically A) moving the vehicle forward at a prescribed speed with the sensors activated, B) stopping the vehicle with a prescribed braked residual advance when one of the sensors signals that something has been sensed, C) determining what sensor has emitted the signal, displacing the carriage into the vicinity of that sensor, and activating the hunting detector, D) probing a prescribed area of the ground with the detector while correspondingly displacing the carriage and pivoting the arm, E) processing the signals emitted by the detector in order to determine the precise nature and position of the detected object, F) actuating the pickup to pick up an explosive or hollow charge stowed in the magazine and positioning it at the point on the ground determined by the processing, G) backing the vehicle up a prescribed distance, H) exploding the explosive or hollow charge from the vehicle, and I) driving the vehicle forward at a prescribed speed with the sensors activated.

14. The method as in claim 13, wherein the sensed object or detected area is monitored and identified during or after acts D and/or F and/or H by a video camera and the result visual information is processed.

* * * * *